US007614171B2

(12) United States Patent
Hsu

(10) Patent No.: US 7,614,171 B2
(45) Date of Patent: Nov. 10, 2009

(54) MOTIVE INFLATABLE DISPLAY

(75) Inventor: Sheng-Hung Hsu, Kaohsiung Hsien (TW)

(73) Assignee: Gemmy Industries Corporation, Coppell, TX (US)

( * ) Notice: Subject to any disclaimer, the term of this patent is extended or adjusted under 35 U.S.C. 154(b) by 125 days.

(21) Appl. No.: 11/723,679

(22) Filed: Mar. 21, 2007

(65) Prior Publication Data

US 2008/0233831 A1 Sep. 25, 2008

(51) Int. Cl.
*G09F 19/08* (2006.01)

(52) U.S. Cl. ..... 40/412; 40/610; 40/414; 446/221

(58) Field of Classification Search ..... 40/414, 40/419, 412, 418
See application file for complete search history.

(56) References Cited

U.S. PATENT DOCUMENTS 2,251,430 A * 8/1941 Taylor ..... 244/134 A
2,327,046 A * 8/1943 Hunter ..... 137/624.14
3,159,935 A * 12/1964 Rubens ..... 40/415
4,480,654 A * 11/1984 Firey ..... 137/119.09
6,447,361 B1 * 9/2002 Akiyama ..... 446/226
6,786,793 B1 * 9/2004 Wang ..... 446/226
7,197,841 B2 * 4/2007 Hsu ..... 40/412
7,216,446 B2 * 5/2007 Machala ..... 40/610
7,267,851 B2 * 9/2007 Hsu et al. ..... 428/9
2007/0022642 A1 * 2/2007 Hsu ..... 40/419
2007/0234604 A1 * 10/2007 Hsu ..... 40/412

OTHER PUBLICATIONS

NYC Mechandise, Gemmy Industries, Buyinflatables.com, May 6, 2006, http://web.archive.org/web/20060506043117/www.buyinflatables.com/productid27771.htm.*
NYC Merchandise, Gemmy Industries, Buyinflatables.com, Feb. 13, 2006, http://web.archive.org/web/20060206090730/buyinflatables.com/halloween_2006.php.*

* cited by examiner

*Primary Examiner*—Lesley D Morris
*Assistant Examiner*—Kristina Staley
(74) *Attorney, Agent, or Firm*—Muncy, Geissler, Olds & Lowe, PLLC

(57) ABSTRACT

A motive inflatable display has a first inflatable compartment, a second inflatable compartment, a third inflatable compartment, a blower and a two position and four opening valve. The second inflatable compartment and the third inflatable compartment are mounted on the first inflatable compartment. The blower is connected to the first inflatable compartment to expend the first inflatable compartment. The two position and four opening valve is connected to the inflatable compartments to expand or flatten the inflatable compartments in turn so that the compartments are able to upraise, down, wave and nod.

12 Claims, 8 Drawing Sheets

MOTIVE INFLATABLE DISPLAY

BACKGROUND OF THE INVENTION

1. Field of the Invention

The present invention relates to a display, and more particularity to a motive inflatable display that is able to upraise, down, nod or wave during the display is inflating and exhausting.

2. Description of Related Art

A conventional display has a body and a blower. The body is hollow and may be a doll or any other kind of hollow shape and has a sidewall and an opening. The opening is formed in the sidewall of the body. The blower is connected to the opening of the body and is able to force air or gas into the body.

When the blower is switched on, the blower forces the air or gas into the body via the opening. The body is inflated to a three dimension shape such as the doll or any kind of desired shape.

However, the shape of the display cannot be changed after the display expands. The expended display only can provide a steady visual effect but cannot provide a motion effect. Therefore, the attraction to public of the conventional display is poor.

To overcome the shortcomings, the present invention provides a motive inflatable display to obviate or mitigate the aforementioned problems.

SUMMARY OF THE INVENTION

The primary objective of the present invention is to provide a motive inflatable display that is able to upraise, down, wave and nod through expending and frustrating.

The motive inflatable display has a first inflatable compartment, a second inflatable compartment, a third inflatable compartment, a blower and a two position and four opening valve. The second inflatable compartment and the third inflatable compartment are mounted on the first inflatable compartment. The blower is connected to the first inflatable compartment to expend the first inflatable compartment. The two position and four opening valve is connected to the inflatable compartments to expend and flatten the inflatable compartments in turn so that the inflatable compartments are able to upraise, down, wave and nod. Because the inflatable compartments are motive so that attraction of the display is improved to attract more people especially in a shopping mall.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
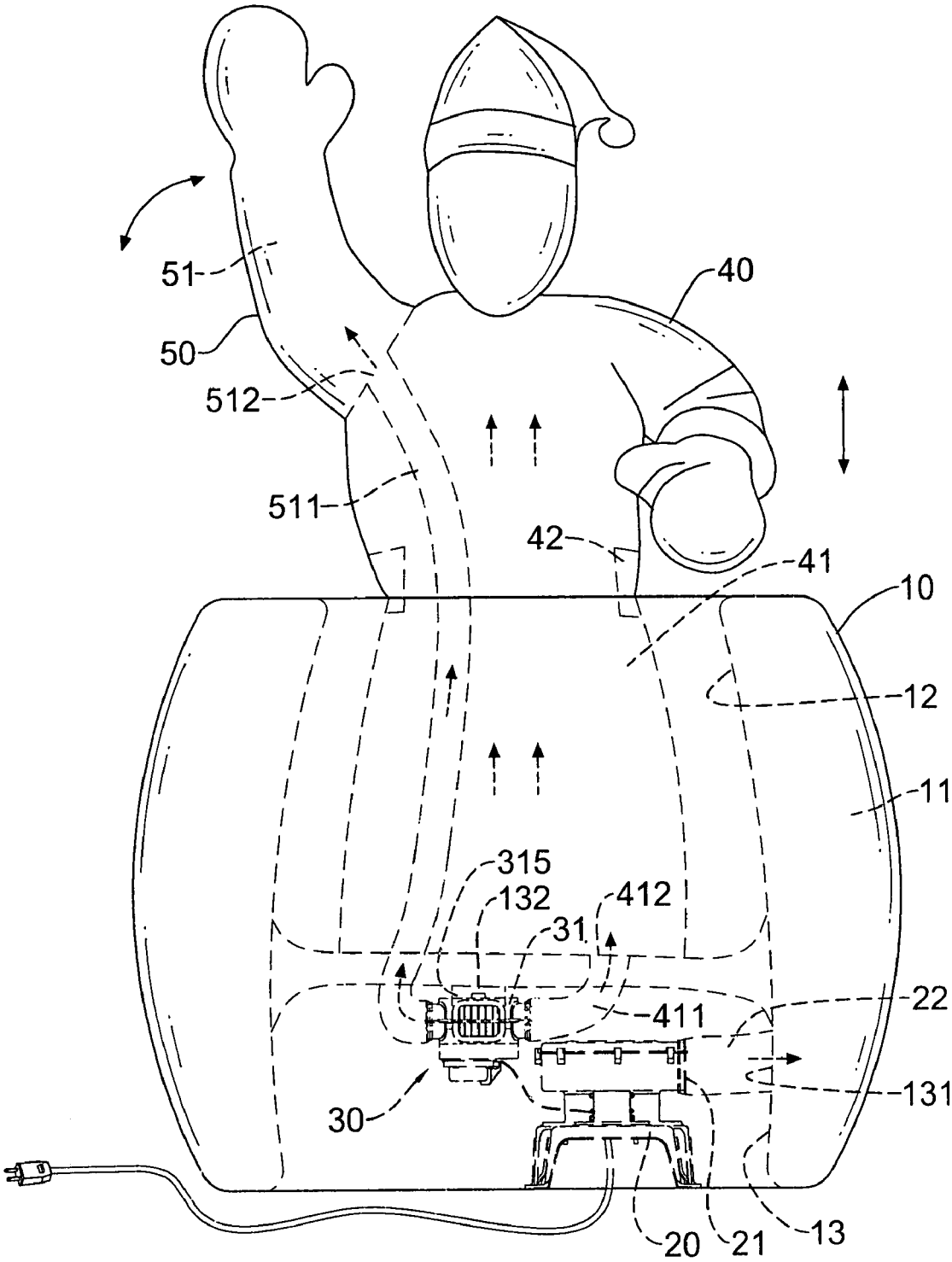
FIG. 1 is a perspective view of a first embodiment of a motive inflatable display in accordance with the present invention.
Figure 6:
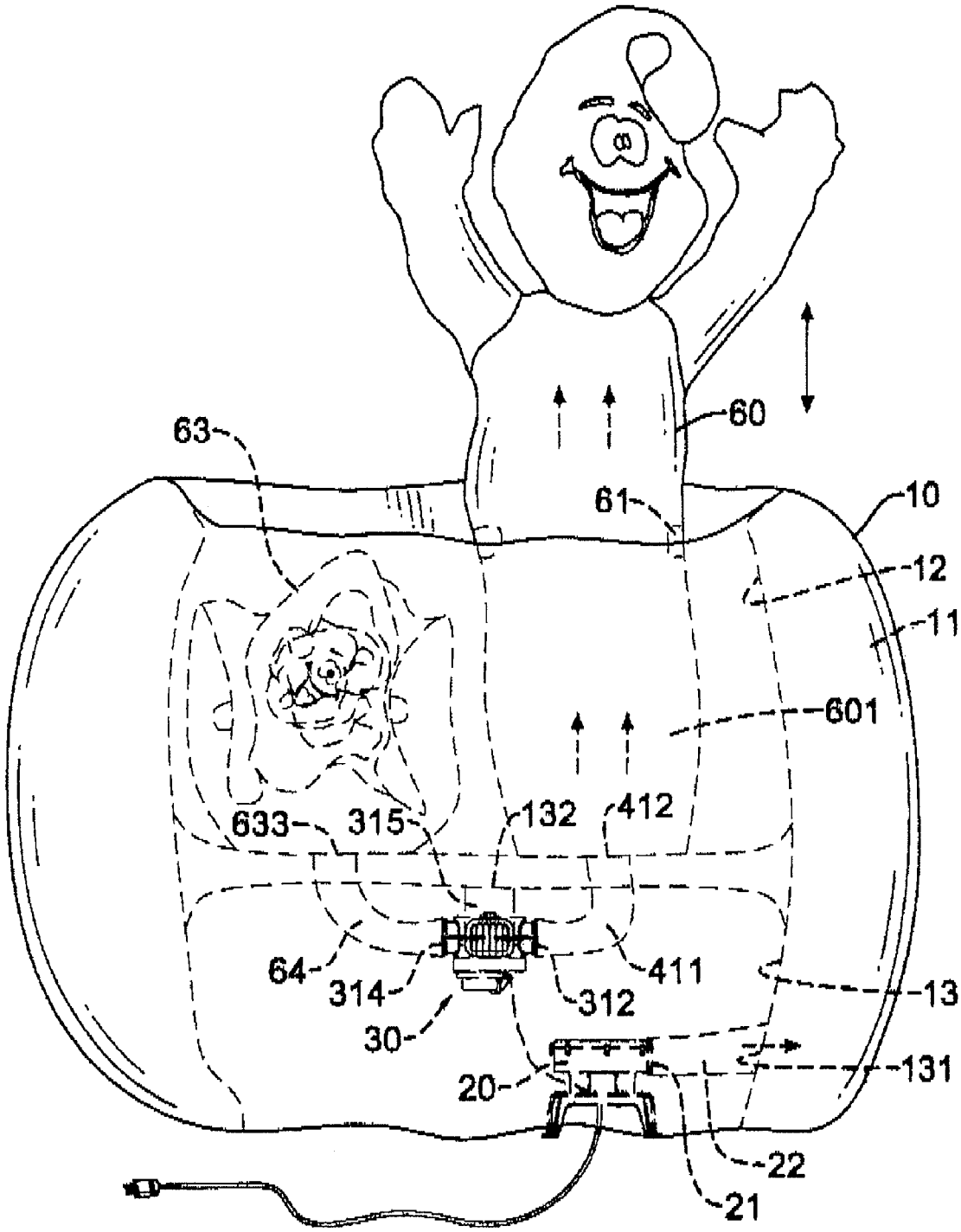
FIG. 6 is an operational perspective view of a second embodiment of a motive inflatable display in accordance with the present invention showing that a second inflatable compartment pops out from a first inflatable compartment.
Figure 8:
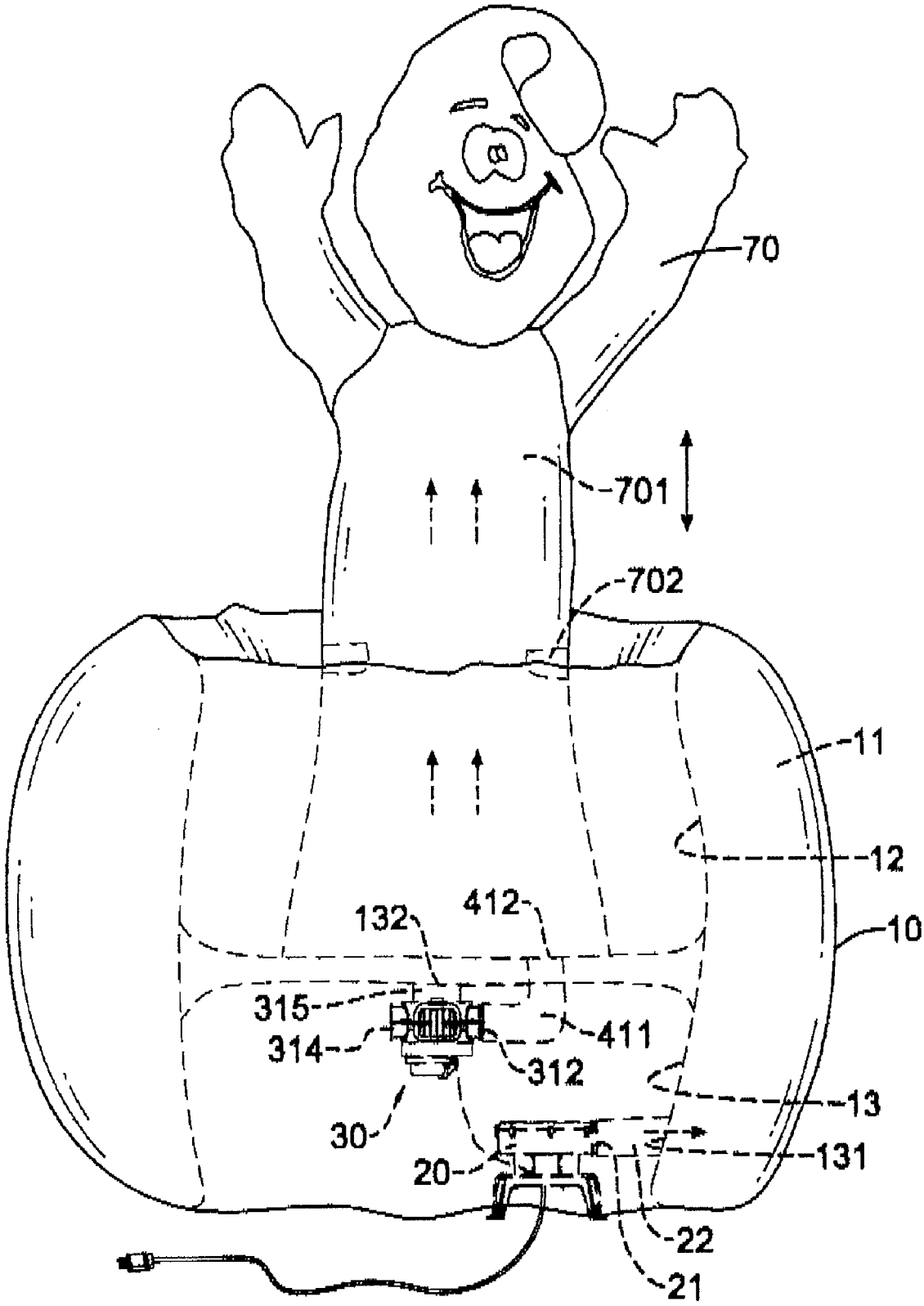
FIG. 8 is an operational perspective view of a third embodiment of a motive inflatable display in accordance with the present invention.

With reference to FIGS. 1, 6 and 8, a motive inflatable display in accordance with the present invention comprises a first inflatable compartment (10), a blower (20), a second inflatable compartment (40, 60, 70), an optional third inflatable compartment (50, 63) and a two position and four opening valve (30).

The first inflatable compartment (10) is hollow, may be a barrel shape and may have an inner wall, an inflating chamber (11), a top, a bottom, a top recess (12) and a bottom recess (13). The inflating chamber (11) is defined in the inner wall of the first compartment (10) and has an opening (131) and an exhausting opening (132). The opening (131) and the exhausting opening (132) are defined in the inner wall of the inflatable compartment (10) and communicate with the inflating chamber (11). The top recess (12) is formed in the top of the first inflatable compartment (10) and has a bottom. The bottom recess (13) is formed in the bottom of the first inflatable compartment (10).

The blower (20) may be located in the bottom recess (13) of the first inflatable compartment (10) and may have an opening (21) and a pipe (22). The opening (21) is defined in the blower (20, 68, 74). The pipe (22, 682, 741) is connected between the opening (21) of the blower (20) and the opening (131) of the first inflatable compartment (10).

The second inflatable compartment (40, 60, 70) is hollow and may be a one-arm doll with a shoulder or a two-arm doll. The second inflatable compartment (40, 60, 70) may have a bottom, two sides, an inflating chamber (41, 601, 701) and multiple weights (42, 61, 702). The bottom of the second inflatable compartment (40, 60, 70) is mounted on the bottom of the top recess (12) of the first inflatable compartment (10). The inflating chamber (41, 601, 701) is defined inside of the second inflatable compartment (40, 60, 70) and has an opening (412). The opening (412) is defined in the second inflatable compartment (40, 60, 70) and communicates with the inflating chamber (41, 601, 701) of the second inflatable compartment (40, 60, 70). The weights (61) are mounted on the sides of the second inflatable compartment (40, 60, 70).

Figure 7:
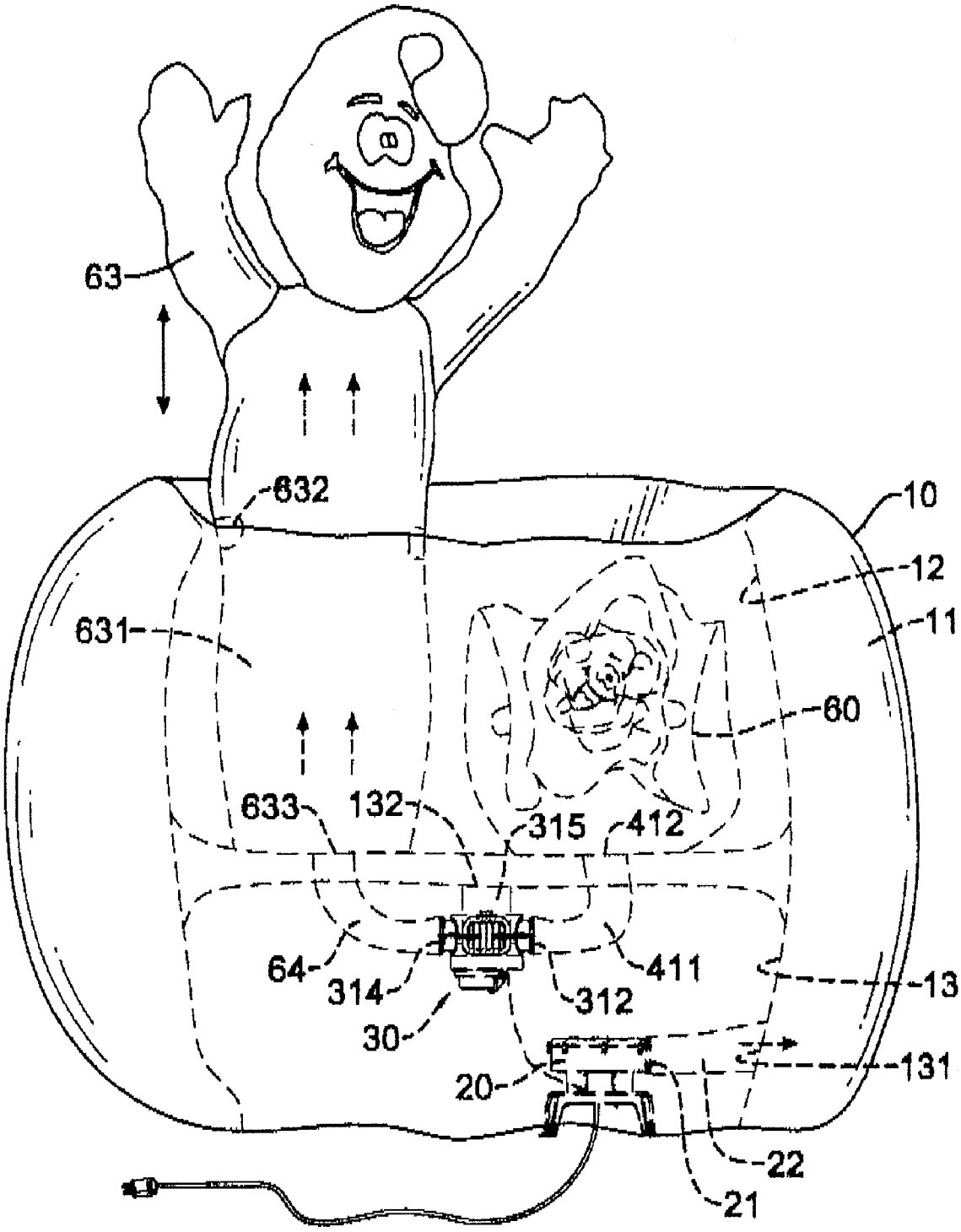
FIG. 7 is an operational perspective view of the motive inflatable display in FIG. 6 showing that a third inflatable compartment pops out form the first inflatable compartment.

With further reference to FIGS. 6 and 7, the third inflatable compartment (50, 63) is hollow and may be an arm or a two-arm doll. The third inflatable compartment (50, 63) may have an inflating chamber (51, 631), a bottom, sides and weights (632). The inflating chamber (51, 631) is defined inside the third inflatable compartment (50, 63) and has an opening (512, 633). The opening (512, 633) is defined in the third inflatable compartment (50, 63) and communicates with the inflating chamber in the third inflatable compartment (50, 63).

If the third inflatable compartment (50) is an arm, the bottom of the third inflatable compartment (50) is mounted on the shoulder of the second inflatable compartment (40).

If the third inflatable compartment (63) is a two-arm doll, the bottom of the first inflatable compartment (63) is mounted on the bottom of the bottom of top recess (66) of the first inflatable compartment (65). The weights (632) are mounted on the sides of the third inflatable compartment (63).

Figure 2:
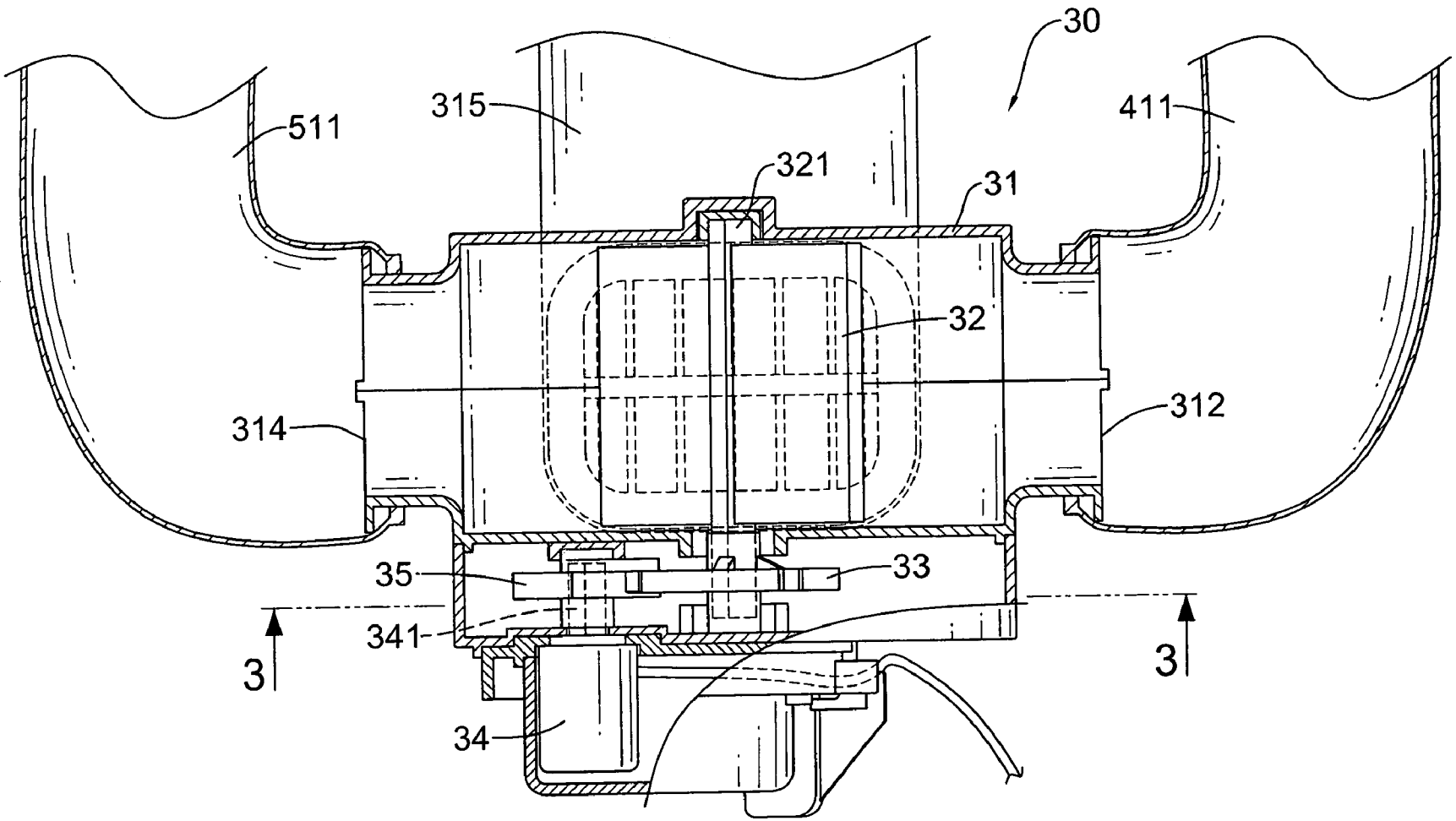
FIG. 2 is an enlarged side view in partial section of a two position and four opening valve of the display in FIG. 1.
Figure 3:
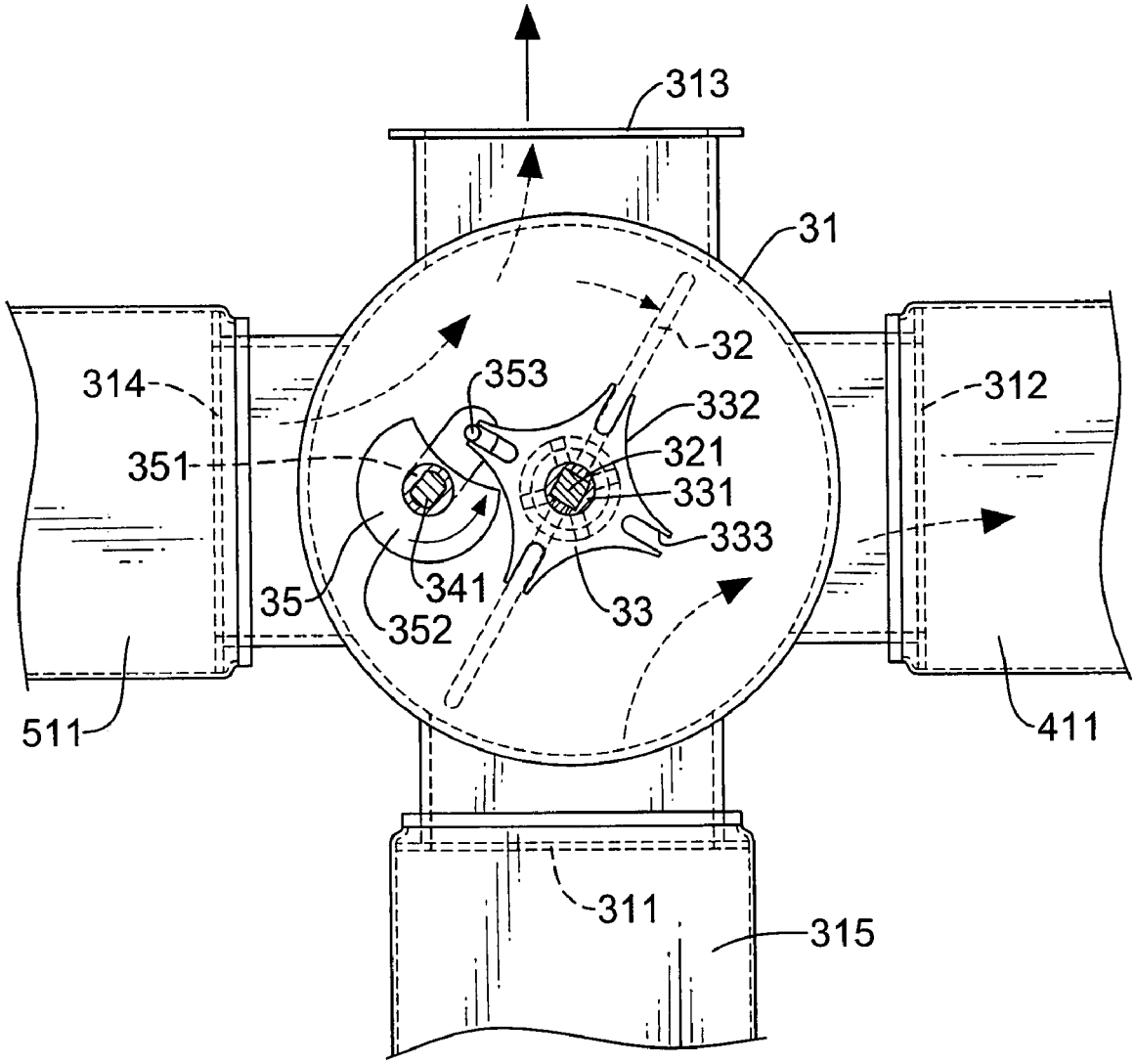
FIG. 3 is an enlarged operational cross sectional bottom view of the two position and four opening valve along line 3-3 in FIG. 2 when a slice is turning.

With further reference to FIGS. 2 and 3, the two position and four opening valve (30) may be located in the bottom recess (13) of the first inflatable compartment (10) and may have a seat (31), a slice (32), a wheel (33), a shaft (35) and a synchronous motor (34).

The seat (31) is hollow and has a chamber, a sidewall, a bottom, a gas-in opening (311), a first inflating opening (312), a gas-out opening (313), a second inflating opening (314) and pipes (315, 411, 511, 64). The chamber is defined inside of the seat (31) and has a top and a bottom. The gas-in opening (311), the first inflating opening (312), the gas-out opening (313) and the second inflating opening (314) are defined in the sidewall and communicate with the chamber of the seat (31). The gas-in opening (311) and the gas-out opening (313) communicate with each other. The first inflating opening (312) and the second inflating opening (314) communicate with each other. The pipe (315) is connected between the gas-in opening (311) of the seat (31) and the exhausting opening of the first inflatable compartment (10). The pipe (411) is connected between the opening (412) of the second inflatable compartment (40, 60, 70) and the first inflating opening (312) of the seat (31).

If the third inflatable compartment (50) is an arm, the pipe (511) is connected between the opening (512) of the third inflatable compartment (50) and the second inflating opening (314) of the seat (31) of the two position and four opening valve (30) and the pipe (511) extends through the inflating chamber (51) of the third inflatable compartment (50).

If the third inflatable compartment is a two-arm doll, the pipe (64) is connected between the opening (633) of the third inflatable compartment (63) and the second inflating opening (314) of the two position and four opening valve (30).

If no pipe is connected to the second inflating opening (314) of the two position and four opening valve (30), the second inflating opening (314) of the two position and four opening valve (30) is sealed.

The slice (32) is rotatably mounted inside of the chamber of the seat (31) and has a center and a rod (321). The rod (321) is mounted on the center of the slice (32) and has a top and a bottom. The top of the rod (321) is rotatably mounted on the top of the chamber of the seat (31). The bottom of the rod (321) extends through the bottom of the chamber of the seat (31).

The wheel (33) and the shaft (35) are Geneva Mechanism. The wheel (33) is located at the bottom of the seat (31) and has a center, a hole (331), a sidewall, multiple curve recesses (332) and multiple receiving recesses (333). The hole (331) is formed through the center of the wheel (33) and receives the bottom of the rod (321) of the slice (32). The curve recesses (332) are formed in the sidewall of the wheel (33) and at intervals of 90 degrees. The receiving recesses (333) are formed in the sidewall of the wheel (33) and each receiving recess (333) is defined between adjacent curve recesses (332) of the wheel (33).

The shaft (35) is located at the bottom of the seat (31) and has a hole (351), a curve end (352), a driving end and a tracking rod (353). The hole (351) is formed through the shaft (35). The curve end (352) is selectively engaged one of the curve recesses (332) of the wheel (33). The tracking rod (353) is mounted on the driving end of the shaft (35), is opposite to the curve end (352) of the shaft (35) and selectively engages one of the receiving recesses (333) of the wheel (33).

The synchronous motor (34) is mounted on the bottom of the seat (31) and has a center shaft (341). The center shaft (341) extends through and engages with the hole (351) of the shaft (35).

Figure 4:
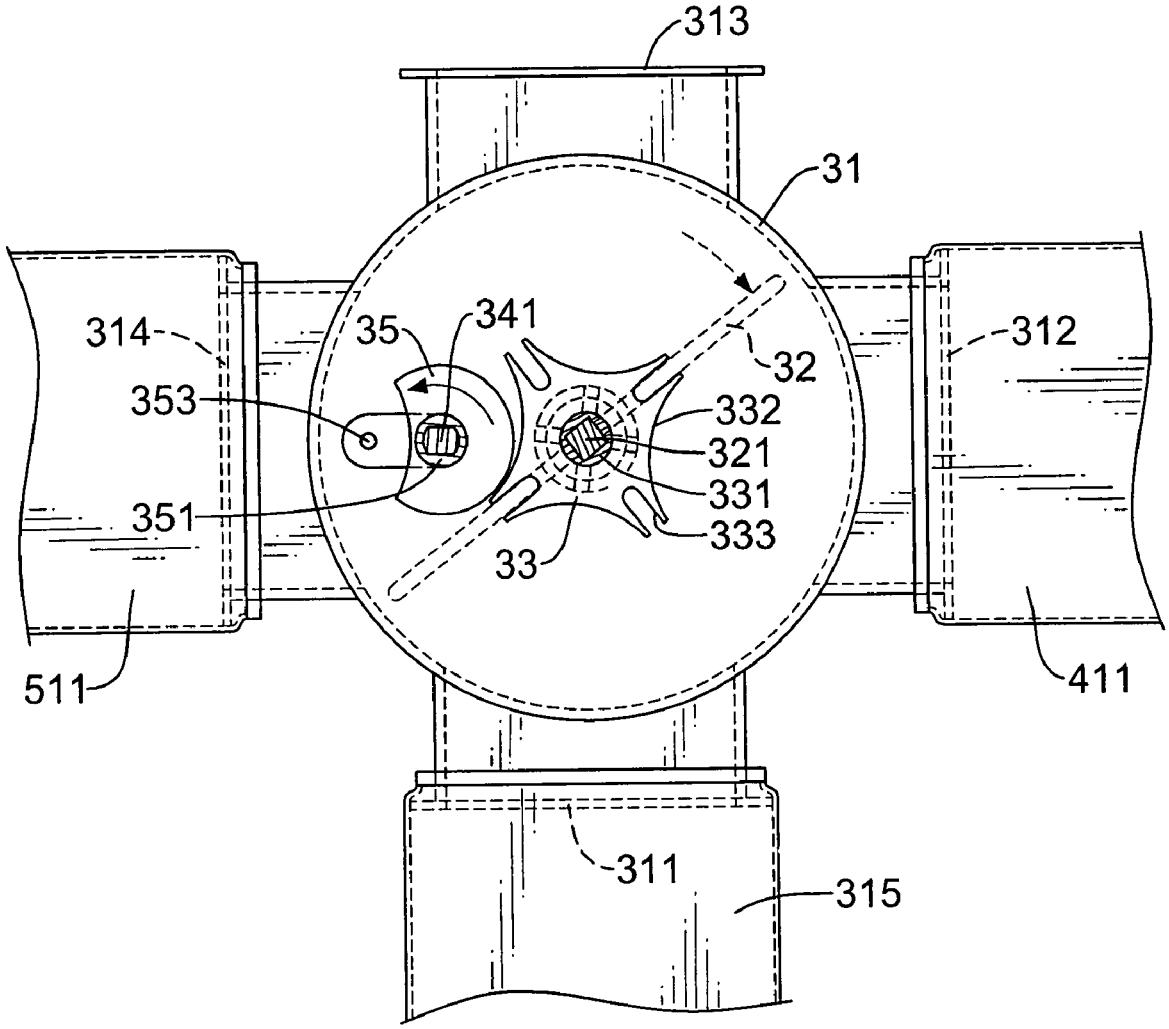
FIG. 4 is an operational cross sectional bottom view of the two position and four opening valve in FIG. 3 when a slice is not turning.
Figure 5:
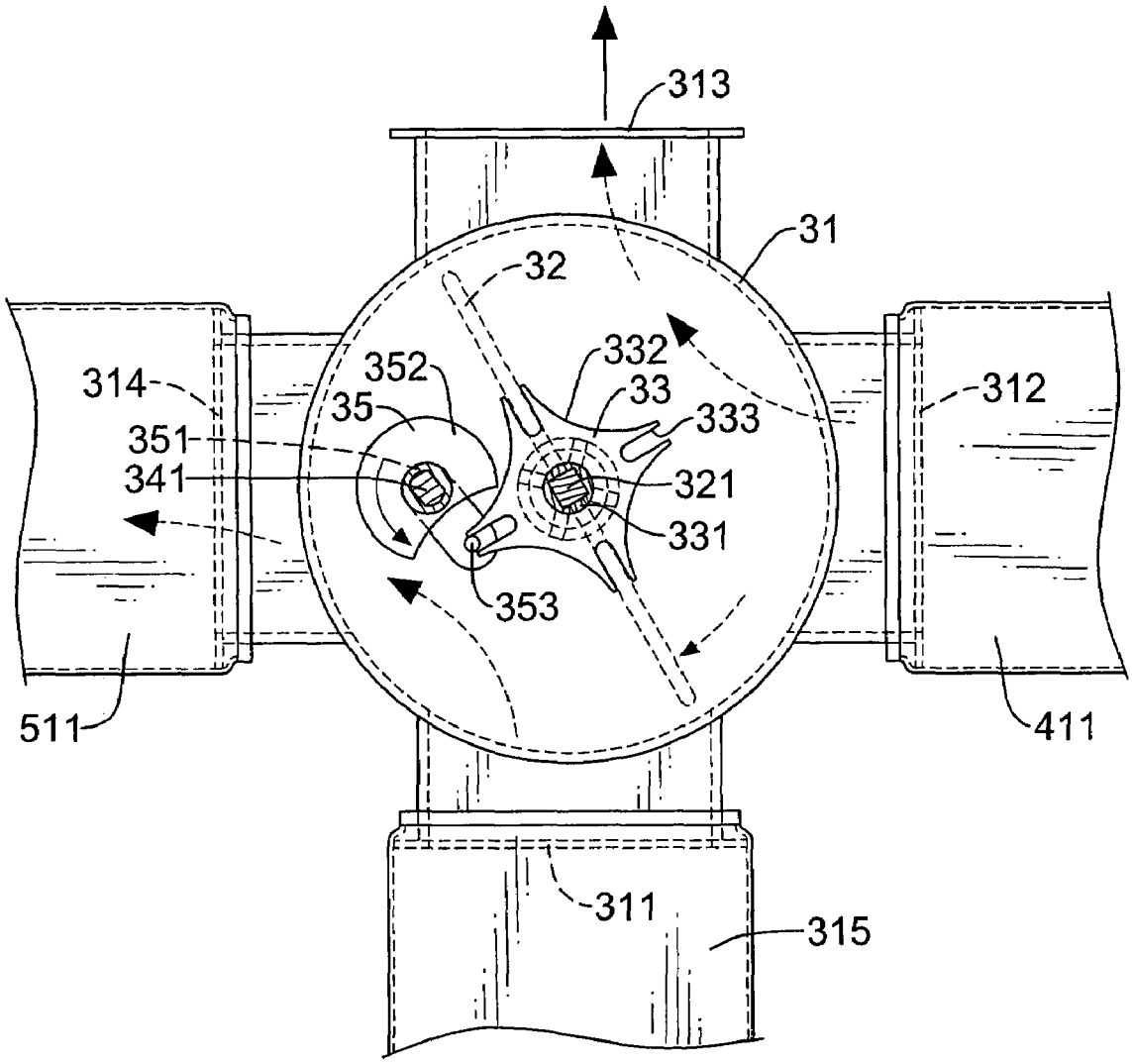
FIG. 5 is an operational cross sectional bottom view of the two position and four opening valve in FIG. 3 when a slice is turning to another direction.

With further reference to FIGS. 3, 4 and 5, when the synchronous motor (34) drives the shaft (35) to rotate, the tracking rod (353) of the shaft (35) engages one of the receiving recesses (333) of the wheel (33) to rotate the wheel (33) with the shaft (35) until the curve end (352) of the shaft (35) engages the receiving recess (333) of the wheel (33). The slice (32) will change a position inside the chamber of the seat (31) with the rotation of the wheel (33). When the position of the slice (32) is changed, one of two situations occurs: such as the gas-in opening (311) is communicated with the second inflating opening (314) and the gas-out opening (313) is communicated with the first inflating opening (312) or the gas-in opening (311) is communicated with the first inflating opening (312) and the gas-out opening (313) is communicated with the second inflating opening (314).

The blower (20) forces gas or air into the inflating chamber (11) of the first inflatable compartment (10) to make the first inflatable compartment (10) expand. After the first inflatable compartment (10) expands, the gas or the air inside the first inflatable compartment (10) flows into the two position and four opening valve (30) via the pipe (315). If the gas-in opening (311) is communicated with the second inflating opening (314) and the gas-out opening (313) is communicated with the first inflating opening (312), the gas or the air exhausted from the first inflatable compartment (10) flows into the inflating chamber (51, 631) of the third inflatable compartment (50, 63) and the air or the gas inside the inflating chamber (41, 601, 701) of the second inflatable compartment (40, 60, 70) flows out so that the third inflatable compartment (50, 63) is expanded and the second inflatable compartment (40, 60, 70) is fattened.

If the gas-in opening (311) is communicated with the first inflating opening (312) and the gas-out opening (313) is communicated with the second inflating opening (314), the gas or the air exhausted from the first inflatable compartment (10) flows into the inflating chamber (41, 601, 701) of the second inflatable compartment (40, 60, 70) and the air or the gas inside the inflating chamber (51, 631) of the third inflatable compartment (50, 63) flows out so that the third inflatable compartment (50, 63) is flattened and the second inflatable compartment (40, 60, 70) is expanded.

Furthermore, if the second inflating opening (314) of the two position and four opening valve (30) is sealed and no third inflatable compartment is mounted on the first inflatable compartment (10), the gas or the air can only flow into or out of the inflating chamber (701) of the second inflatable compartment (70) so that only the second inflatable compartment (70) is flattened or expended with the rotation of the slice (32).

The weights (42, 61, 702) of the second inflatable compartment (40, 60, 70) and the weights (632) of the third inflatable compartment (63) may force the second inflatable compartment (40, 60, 70) or the third inflatable compartment (63) to shrink back into the top recess (12) of the first inflatable compartment (10) when the second inflatable compartment (40, 60, 70) or the third inflatable compartment (63) is flattened.

Consequently, the second inflatable compartment (40, 60, 70) moves up and down during the second inflatable compartment (40, 60, 70) is expanded or flattened so that the shape of the second inflatable compartment (40, 60, 70) is able to rise, down or nod. If the third inflatable compartment (50) is an arm, the third inflatable compartment (50) is able to wave during the third inflatable compartment (50) is expended or flattened. If the third inflatable compartment (63) is a doll, the third inflatable compartment (63) is able to upraise, down or nod during the third inflatable compartment (63) is expended or flattened.

The two position and four opening valve (30) is able to change the flow of the gas or the air so that the second inflatable compartment (40, 60, 70) and the third inflatable compartment (50, 63) are able to expend or flatten in turn so that the second inflatable compartment (40, 60, 70) and the third inflatable compartment (50, 63) are able to perform more movement to attract more people.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A motive inflatable display comprising:

a first inflatable compartment being hollow;

a single blower connected to the first inflatable compartment to expand the first inflatable compartment;

a second inflatable compartment being hollow and mounted on the first inflatable compartment; and a two position and four opening valve connected between the first inflatable compartment and the second inflatable compartment to control the second inflatable compartment expanding and the two position and four opening value comprising:

a seat being hollow and having a chamber defined inside of the seat and having a top free of any opening; and a bottom;

a sidewall;

a bottom;

a gas-in opening defined in the sidewall of the seat and communicating with the chamber of the seat;

a first inflating opening defined in the sidewall of the seat and communicating with the chamber of the seat;

a gas-out opening defined in the sidewall of the seat and communicating with the chamber of the seat;

a second inflating opening defined in the sidewall of the seat and communicating with the chamber of the seat; and multiple pipes, a first pipe connected between the gas-in opening of the seat and the first inflatable compartment and a second pipe connected between the second inflatable compartment and the first inflating opening of the seat;

a slice rotatably mounted inside of the chamber of the seat and having a rod having a top pivotally mounted on the top of the chamber of the seat; and a bottom pivotally mounted and extending through the bottom of the chamber of the seat;

a wheel located at the bottom of the seat and having a hole formed through the center of the wheel and receiving the bottom of the rod of the slice; and multiple curve recesses and multiple receiving recesses formed in a sidewall of the wheel, and each receiving recess being defined between adjacent curve recesses of the wheel;

a shaft located at the bottom of the seat and having a hole formed through the shaft;

a curve end selectively engaged one of the curve recesses of the wheel;

a driving end; and a tracking rod mounted on the driving end of the shaft, opposite to the curve end of the shaft and selectively engaging one of the receiving recesses of the wheel; and a synchronous motor mounted on the bottom of the seat and having a center shaft that extends through and engages with the hole of the shaft.

2. The motive inflatable display as claimed in claim 1, wherein the first inflatable compartment is hollow and has an inner wall;

an inflating chamber defined in the first compartment and having an opening defined in the inner wall and communicating with the inflating chamber of the first compartment; and an exhausting opening defined in the inner wall, communicating with the inflating chamber of the first compartment and connecting with the first pipe;

the blower has an opening defined in the blower; and a pipe connected between the opening of the blower and the opening of the first inflatable compartment; and the second inflatable compartment has an inflating chamber defined inside of the second inflatable compartment and having an opening defined in the second inflatable compartments, communicating with the inflating chamber of the second inflatable compartment and connecting with the second pipe.

3. The motive inflatable display as claimed in claim 2, wherein the gas-in opening of the seat and the gas-out opening of the seat are corresponded to each other; and the first inflating opening of the seat and the second inflating opening of the seat are corresponded to each other.

4. The motive inflatable display as claimed in claim 3, wherein the curve recesses of the wheel are at intervals of 90 degrees.

5. The motive inflatable display as claimed in claim 4, wherein a third inflatable compartment is mounted on the second inflatable compartment, is hollow and has an inflating chamber defined inside the third inflatable compartment; and an opening defined in the inflating chamber of the third inflatable compartment and connected to the second inflating opening of the two position and four opening valve through a pipe.

6. The motive inflatable display as claimed in claim 5, wherein the second inflatable compartment is a one-arm doll with a shoulder and has multiple sides; and multiple weights mounted on the sides of the second inflatable compartment; and the third inflatable compartment is mounted on the shoulder of the second inflatable compartment.

7. The motive inflatable display as claimed in claim 6, wherein the first inflatable compartment is a barrel and has a top;

a bottom;

a top recess formed in the top of the first inflatable compartment, receiving the second inflatable compartment inside and having a bottom; and a bottom recess formed in the bottom of the first inflatable compartment and receiving the blower and the two position and four opening valve inside;

the second inflatable compartment has a bottom mounted on the bottom of the top recess of the first inflatable compartment.

8. The motive inflatable display as claimed in claim 4, wherein the first inflatable compartment is a barrel and has a top;

a bottom;

a top recess formed in the top of the first inflatable compartment, receiving the second inflatable compartment inside and having a bottom; and a bottom recess formed in the bottom of the first inflatable compartment and receiving the blower and the two position and four opening valve inside;

the second inflatable compartment is two-arm doll and has a bottom mounted on the bottom of the top recess of the first inflatable compartment; and the second inflating opening of the two position and four opening valve is sealed.

9. The motive inflatable display as claimed in claim 8, wherein the second inflatable compartment is a one-arm doll with a shoulder and has multiple sides; and multiple weights mounted on the sides of the second inflatable compartment.

10. The motive inflatable display as claimed in claim 4, wherein the first inflatable compartment is a barrel and has a top;

a bottom;

a top recess formed in the top of the first inflatable compartment, receiving the second inflatable compartment inside and having a bottom; and a bottom recess formed in the bottom of the first inflatable compartment and receiving the blower and the two position and four opening valve inside;

a third inflatable compartment is hollow and has an inflating chamber defined inside the third inflatable compartment; and an opening defined in the third inflatable compartment and communicating with the inflating chamber of the third inflatable compartment and connected to the second inflating opening of the two position and four opening valve through a pipe; and a bottom mounted on the bottom of the top recess of the first inflatable compartment.

11. The motive inflatable display as claimed in claim 10, wherein the second inflatable compartment has a bottom mounted on the bottom of the top recess of the first inflatable compartment adjacent to the third inflatable compartment.

12. The motive inflatable display as claimed in claim 10, wherein the second inflatable compartment is a two-arm doll and has multiple sides; and multiple weights mounted on the sides of the second inflatable compartment;

the third inflatable compartment is an two-arm doll and has multiple sides; and multiple weights mounted on the sides of the third inflatable compartment.

* * * * *